US007058334B2

(12) United States Patent
Do et al.

(10) Patent No.: US 7,058,334 B2
(45) Date of Patent: Jun. 6, 2006

(54) ELECTRO-PHOTOGRAPHIC IMAGE FORMING APPARATUS HAVING A FUNCTION FOR PREVENTING TONER FOR SCATTERING AND CONTROL METHOD FOR THE SAME

(75) Inventors: Ki-jae Do, Suwon-si (KR); Jeong-seon Kim, Suwon-si (KR); In-cheol Jeon, Suwon-si (KR); Valery KrasnosloBoditsev, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 162 days.

(21) Appl. No.: 10/841,446

(22) Filed: May 10, 2004

(65) Prior Publication Data

US 2005/0053392 A1 Mar. 10, 2005

(30) Foreign Application Priority Data

Sep. 9, 2003 (KR) ..... 10-2003-0063386

(51) Int. Cl.
*G03G 15/06* (2006.01)
*G03G 15/08* (2006.01)

(52) U.S. Cl. ..... 399/98; 399/55; 399/285

(58) Field of Classification Search ..... 399/98, 399/99, 53, 55, 71, 343, 222, 252, 285, 270, 399/296

See application file for complete search history.

(56) References Cited

U.S. PATENT DOCUMENTS

| | | | | |
|---|---|---|---|---|
| 4,947,211 A | | 8/1990 | Ono et al. | 399/105 |
| 5,177,533 A | * | 1/1993 | Ishiguro et al. | 399/130 |
| 5,581,336 A | * | 12/1996 | Matsuzaki et al. | 399/270 |
| 5,911,098 A | * | 6/1999 | Gyotoku et al. | 399/270 X |
| 6,125,244 A | * | 9/2000 | Kamiya | 399/44 |

FOREIGN PATENT DOCUMENTS

| | | | |
|---|---|---|---|
| JP | 60-095562 A | * | 5/1985 |
| JP | 61-014664 A | * | 1/1986 |
| JP | 61-014674 A | * | 1/1986 |
| JP | 62-269180 | | 11/1987 |
| JP | 05-249823 A | * | 9/1993 |
| JP | 11-174792 | | 7/1999 |
| JP | 2000-330377 A | * | 11/2000 |
| KR | 2003-49991 | | 6/2003 |

* cited by examiner

*Primary Examiner*—Sophia S. Chen
(74) *Attorney, Agent, or Firm*—Staas & Halsey LLP

(57) ABSTRACT

An electro-photographic image forming apparatus preventing toner from scattering during a printing operation and a control method of the same. The electro-photographic image forming apparatus includes a scattering preventive member being disposed downstream of the developing roller at a predetermined distance from the photosensitive medium, and a voltage being applied, and a controller controlling the voltage that is applied to the scattering preventive member so as to transport the toner attached on the scattering preventive member to the photosensitive medium.

15 Claims, 8 Drawing Sheets

ELECTRO-PHOTOGRAPHIC IMAGE FORMING APPARATUS HAVING A FUNCTION FOR PREVENTING TONER FOR SCATTERING AND CONTROL METHOD FOR THE SAME

CROSS-REFERENCE TO RELATED APPLICATIONS

This application claims the benefit of Korean Patent Application No. 2003-63386 filed Sep. 9, 2003, in the Korean Intellectual Property Office, the disclosure of which is incorporated herein by reference.

BACKGROUND OF THE INVENTION

1. Field of the Invention

The present invention relates to an electro-photographic image forming apparatus such as a laser printer, a facsimile, a copier, etc., and more particularly, to an electro-photographic image forming apparatus preventing toner from scattering when printing.

2. Description of the Related Art

FIG. 1 shows schematically an example of an electro-photographic image forming apparatus using non-magnetic one-component toner, and FIG. 2 is a sectional view showing a developing part of the electro-photographic image forming apparatus in detail. Referring to FIGS. 1 and 2, a surface of a photosensitive medium 1 is charged by a charging roller 2, and a laser beam 4 emitted from a laser scanning unit 3 forms an electrostatic latent image thereon. The non-magnetic toner 8 is supplied to a developing roller 5 by a toner supply roller 6. The developing roller 5 is disposed opposite to the photosensitive medium 1 a predetermined distance apart from the photosensitive medium 1. The developing roller 5 rotates in the D2 direction shown in FIG. 2. The toner supply roller 6 is disposed inside a toner hopper 10 so as to be contacted with the developing roller 5. The toner supply roller 6 comprises a core shaft made of stainless steel, etc., and an elastic member such as urethane foam or silicone foam to cover the core shaft. The toner supply roller 6 rotates in the D3 direction in contact with the developing roller 5 so as to transport the non-magnetic toner 8 within the toner hopper 10 to the surface of the developing roller 5, and remove the toner, which remains on the surface of the developing roller 5 that is not used to develop the electrostatic latent image, from the surface of the developing roller 5. The toner is transported from the toner supply roller 6 to the developing roller 5 by an electrical field between the developing roller 5 and the toner supply roller 6. Here, reference number 22 is an electrical power source that applies the voltage to the toner supply roller 6. A regulating member 7 is disposed in contact with the surface of the developing roller 5 in a position next to the toner supply roller 6 and before a developing area A predetermined electric charge is applied to the toner transported to the developing roller 5 by high friction between the surface of the developing roller 5 and the regulating member 7 while the regulating member 7 regulates the toner at a predetermined thickness. The toner passed through the regulating member 7 develops the electrostatic latent image formed on the photosensitive medium 1. Because the developing roller 5 is at the predetermined gap apart from the photosensitive medium 1 and is applied with a square wave of an alternating current (AC) superposed with a direct current (DC) component by an electrical power source 21, the toner transported to the developing area by the developing roller 5 develops the electrostatic latent image on the surface of the photosensitive medium 1 while the toner reciprocates in the gap of the developing area. The toner developing the electrostatic latent image is transferred to a sheet of paper 13 by a transfer roller 11, and is fixed thereon by the fixing device 17. Thus, a printing operation is completed. Also, the toner, which remains on the surface of the photosensitive medium 1 after the electrostatic latent image is transferred to the sheet of paper 13, is removed by a cleaner 15 and collected into a used toner container 16.

In the case of non-contact development as described above, since the alternating current (AC) voltage superposed with the direct current (DC) is applied to the developing roller 5 when developing (an image area of the VDO-data chart of a control-timing diagram in FIG. 3), the toner blows and reciprocates in the gap of the developing area. Therefore, because toner that is insufficiently charged receives a weak electrical attraction force from the electric field formed in the gap of the developing area between the developing roller 5 and the photosensitive medium 1, the insufficiently charged toner is scattered inside the apparatus like the toner (T) shown in FIG. 4. Because airflow (F) caused by the rotation of the photosensitive medium 1 and the developing roller 5 is stronger as a printing speed increases, the toner scattered by the airflow is increased. Therefore, there are problems that the inside of the image forming apparatus is contaminated and a printing quality is deteriorated by loose toner contaminating images.

SUMMARY OF THE INVENTION

Therefore, it is an aspect of the present invention to provide an electro-photographic image forming apparatus preventing toner blowing in a developing area from scattering out of the developing area and a control method for the same.

It is another aspect of the present invention to provide an electro-photographic image forming apparatus which periodically cleans the scattered toner attached on a scattering preventive member and a control method for the same.

Additional aspects and/or advantages of the invention will be set forth in part in the description which follows and, in part, will be obvious from the description, or may be learned by practice of the invention.

To achieve the aforementioned aspects and/or other features of the present invention, there is provided an electro-photographic image forming apparatus preventing toner from scattering, which has a photosensitive medium, and a developing roller being opposite to the photosensitive medium and transporting the toner to the photosensitive medium. The electro-photographic image forming apparatus includes: a scattering preventive member being disposed downstream of the developing roller at a predetermined distance from the photosensitive medium, and being applied with voltage and a controller controlling the voltage that is applied to the scattering preventive member so as to transport the toner attached on the scattering preventive member to the photosensitive medium.

In an alternative aspect, a gap between the scattering preventive member and the photosensitive medium is equal to or larger than a gap between the developing roller and the photosensitive medium.

In another aspect the controller controls the voltage applied to the scattering preventive member periodically when a non-image area of the photosensitive medium faces the scattering preventive member so as to transport the toner attached on the scattering preventive member to the photosensitive medium.

In another aspect the controller controls a size of a cleaning voltage, which is applied to the scattering preventive member when the toner attached on the scattering preventive member is transported to the photosensitive medium, so that the cleaning voltage is different from a size of a scattering preventive voltage which is applied to the scattering preventive member when the toner is transported from the developing roller to the photosensitive medium. In this aspect, the size of the cleaning voltage is greater than the size of the scattering preventive voltage.

In another aspect, the controller forms an electrostatic latent image with a predetermined size on the non-image area of the photosensitive medium, and applies the cleaning voltage to the scattering preventive member when the electrostatic latent image faces the scattering preventive member so as to transport the toner attached on the scattering preventive member to the photosensitive medium.

In another aspect the voltage is applied to the scattering preventive member by an electrical power source which applies the voltage to the developing roller or a separate electrical power source. In this aspect, the electrical power source may be an alternating current (AC) superposed with a direct current (DC) or a direct current (DC).

As another aspect of the present invention, there is provided a control method for an electro-photographic image forming apparatus, including a scattering toner attaching operation of attaching toner, which scatters between a developing roller and a photosensitive medium, to a scattering preventive member disposed downstream of the developing roller; a toner cleaning operation of transporting the toner attached on the scattering preventive member to a non-image area of the photosensitive medium; and a toner collecting operation of collecting the toner attached on the non-image area of the photosensitive medium into a used toner container.

In another aspect, the toner cleaning includes forming an electrostatic latent image at the non-image area of the photosensitive medium; applying a cleaning voltage to the scattering preventive member when the electrostatic latent image faces the scattering preventive member; and applying a scattering preventive voltage to the scattering preventive member when the electrostatic latent image passes by the scattering preventive member.

In another aspect, the toner cleaning step is executed after a predetermined amount of printing occurs, or just before stopping a main motor of the electro-photographic image forming apparatus after a printing operation completes.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
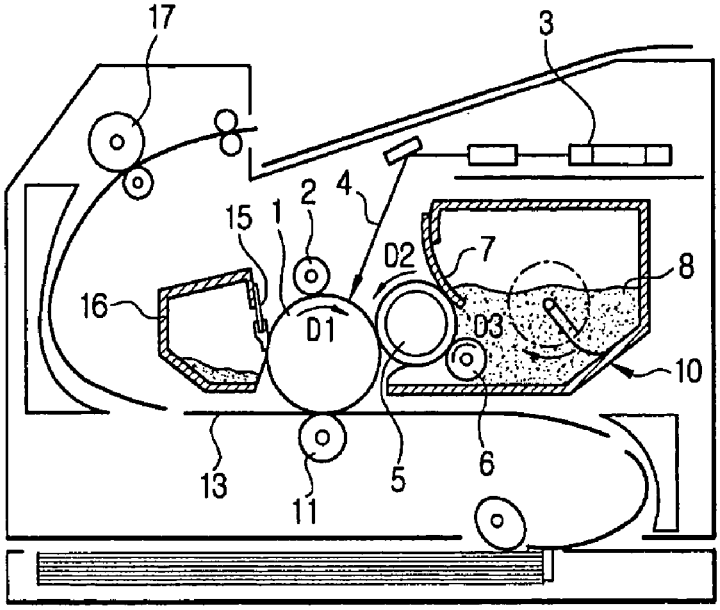
FIG. 1 (PRIOR ART)
FIG. 1 is a schematic sectional view showing a conventional electro-photographic image forming apparatus.
Figure 2:
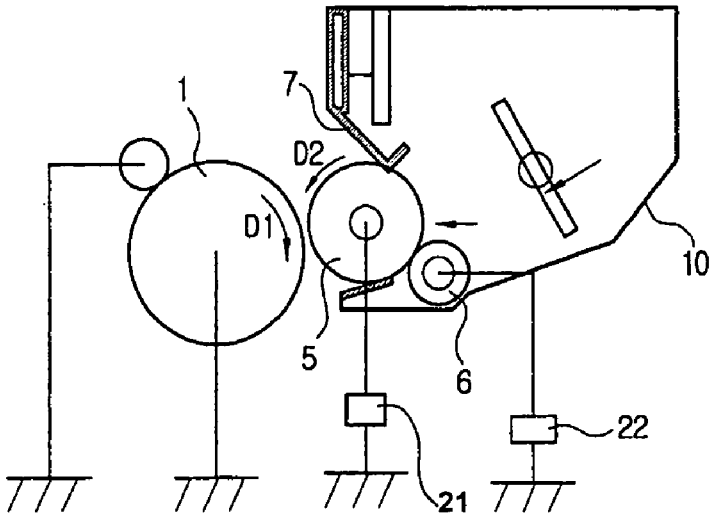
FIG. 2 (PRIOR ART)
FIG. 2 is a sectional view showing a developing part of the electro-photographic image forming apparatus shown in FIG. 1.
Figure 3:
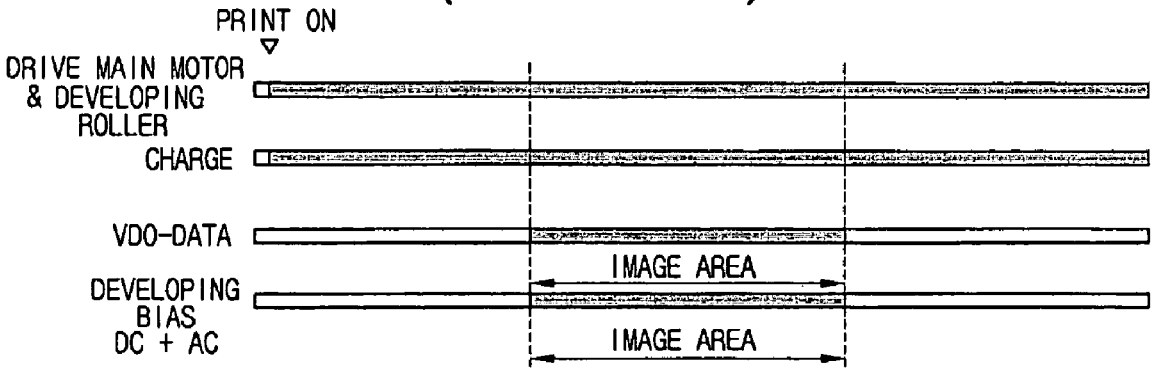
FIG. 3 (PRIOR ART)
FIG. 3 is a control-timing diagram of the electro-photographic image forming apparatus shown in FIG. 1.
Figure 4:
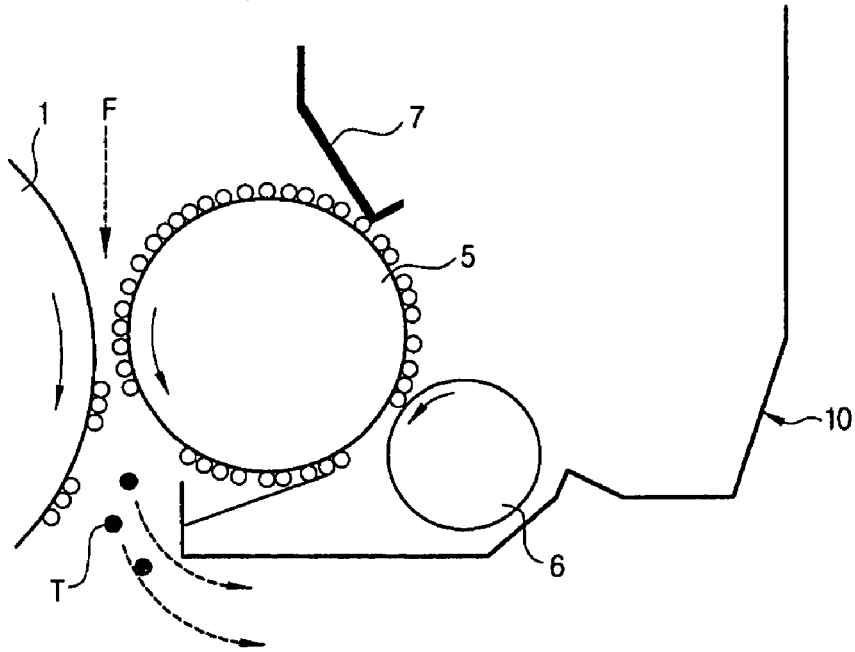
FIG. 4 (PRIOR ART)
FIG. 4 is a drawing showing toner scattering out of a developing area of the electro-photographic image forming apparatus shown in FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

An electro-photographic image forming apparatus preventing toner scattering according to the present invention includes a developing part and some functions of a controller as compared with the conventional electro-photographic image forming apparatus.

Figure 5:
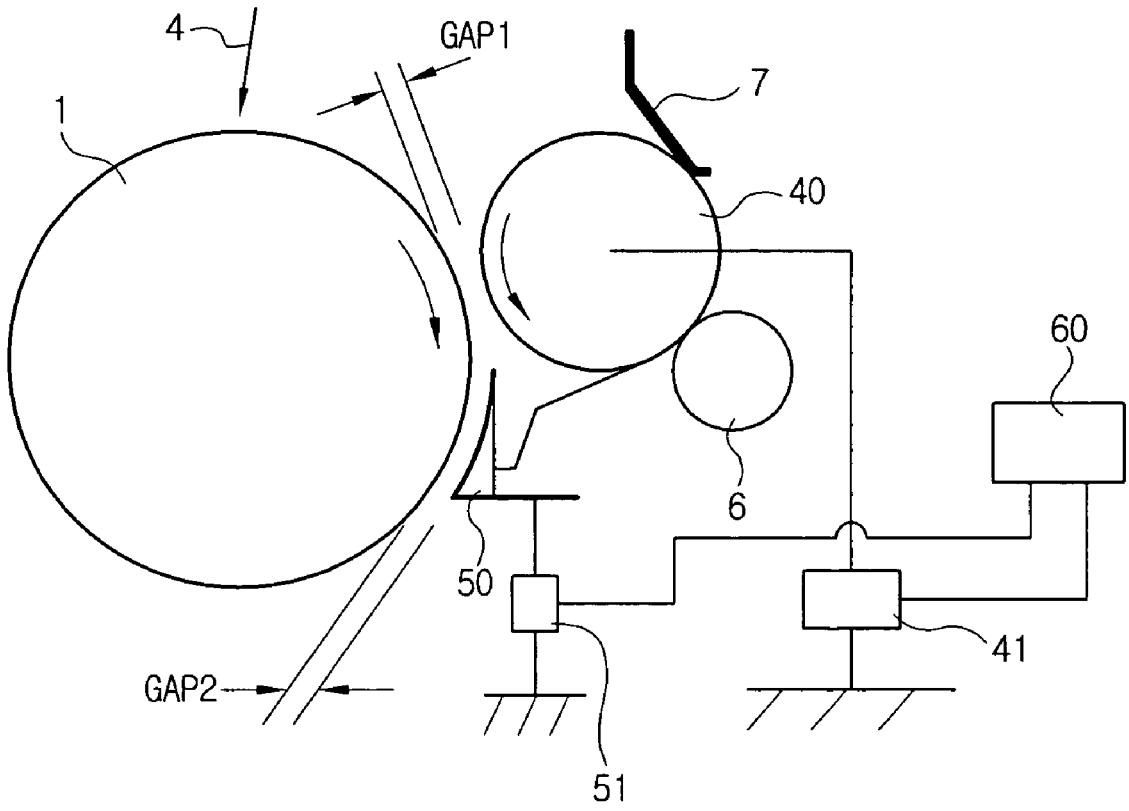
FIG. 5 is a sectional view showing a developing part of the electro-photographic image forming apparatus according to an embodiment of the present invention.

Referring to FIG. 5, an electro-photographic image forming apparatus includes a photosensitive medium 1, and a developing part that includes a developing roller 40, a scattering preventive member 50, and a controller 60.

An electrostatic latent image is formed on a surface of the photosensitive medium 1 by a laser beam 4 emitted from a laser-scanning unit (not shown). The developing roller 40 is disposed opposite of the photosensitive medium 1 at a predetermined distance (GAP1), and transports toner to a space where a surface of the photosensitive medium 1 and a surface of the developing roller 40 face each other (hereinafter, referred to as a "developing area"). It is beneficial that the gap (GAP1) between the developing roller 40 and the photosensitive medium 1 ranges from 150 to 300 μm. The developing roller 40 is disposed at a toner hopper, which holds toner, and is contacted with a toner supply roller 6 disposed inside the toner hopper, thereby forming a predetermined nip. The developing roller 40 is an elastic roller that is generally made of NBR rubber material. A surface roughness of the developing roller 40 ranges from 3 to 9 μm, and an electrical resistance thereof ranges from $1\times10^5\Omega$ to $5\times10^6\Omega$. Voltage applied to the developing roller 40 is the alternating current (AC) voltage superposed with the direct current (DC) voltage component. One example of the electrical power source, which applies the voltage to the developing roller 40, is the alternating current (AC) voltage being Vpp=1.8 kV, f=2.0 kHz, Duty (−)=35%, and the direct current (DC) voltage being Vdc=−500V. Additionally, another example of the electrical power source may use only the direct current (DC) electrical power source for applying the voltage to the developing roller 40.

The toner supply roller 6 comprises a shaft made, for example, of stainless steel and an elastic member such as urethane foam or silicone foam to cover the shaft. Voltage is applied to the toner supply roller 6 while a developing bias is applied to the developing roller 40. The direct current (DC) component of the voltage applied to the toner supply roller 6 is Vdc=−700V, and the alternating current (AC) component thereof is the same size as the developing bias. The voltage applied to the toner supply roller 6 transports the toner from the toner supply roller 6 to the developing roller 40.

A regulating member 7 is disposed between the photosensitive medium 1 and the toner supply roller 6 so as to regulate the toner transported by the developing roller 40 in a predetermined thickness. The regulating member 7, which is made of metal, for example, a stainless steel plate, is contacted with the developing roller 40 with pressure ranging from 10 to 50 g/cm, and the same voltage that is applied to the developing roller 40 is applied to the regulating member 7.

The toner is non-magnetic toner and shattered toner which thermoplastic resin such as polyester mixed with pigment that is shattered and distributed. A mean diameter of the toner is 8.0 μm. It is understood that the present invention may utilize other types of non-magnetic toners.

The scattering preventive member 50 is disposed a predetermined distance (GAP2) apart from the photosensitive medium 1 in a downstream of the airflow generated by rotation of the developing roller 40 and the photosensitive medium 1, that is, in a downstream side of the developing roller 40. The gap (GAP2) between the scattering preventive member 50 and the photosensitive medium 1 is larger than the gap (GAP1) between the developing roller 40 and the photosensitive medium 1. It is beneficial to keep the gap (GAP 2) as narrow as possible. The scattering preventive member 50 is shaped into a curved surface corresponding to the surface of the photosensitive medium 1 to allow the toner scattered from the developing area to be easily attached to a surface thereof. The scattering preventive member 50 is made of a conductive material such as stainless steel. An electrical power source 51 applying voltage to the scattering preventive member 50 is different from the electrical power source 41 applying voltage to the developing roller 40. At this time, the voltage applied to the scattering preventive member 50 is an alternating current (AC) voltage superposed with a direct current (DC) voltage component or only a direct current (DC) voltage.

Figure 8:
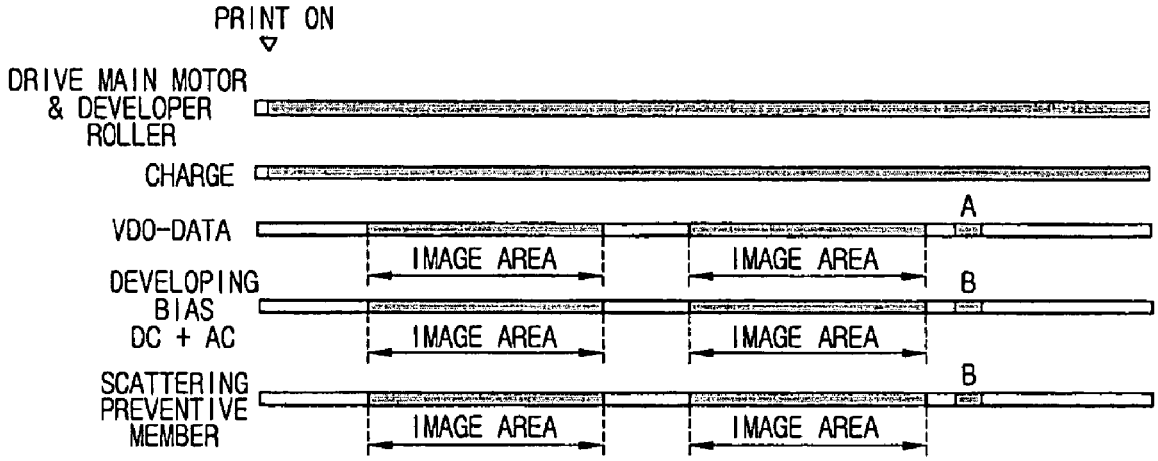
FIG. 8 is a control-timing diagram of the electro-photographic image forming apparatus shown in FIG. 5.

The controller 60 controls the voltages applied to the scattering preventive member 50 and the developing roller 40 in accordance with a main motor (not shown) and the developing roller 40 driving as shown in the control-timing diagram of FIG. 8. The size of the voltage applied to the scattering preventive member 50 absorbing the toner scattering from the developing area when the toner is transported from the developing roller 40 to the surface of the photosensitive medium 1 during printing operation (hereinafter, referred to as "scattering preventive voltage (Vb)") is different from the size of the voltage applied to the scattering preventive member 50 transporting the toner attached on the scattering preventive member 50 to the surface of the photosensitive medium 1 (hereinafter, referred to as "cleaning voltage (Vc)"). At this time, the absolute value of the cleaning voltage is larger than the absolute value of the scattering preventive voltage. In other words, the controller 60 controls the scattering preventive voltage so as to satisfy the follow formula.

$$|Vb|<|Vc|$$

here, Vb is the scattering preventive voltage and Vc is the cleaning voltage.

The operation of the embodiment of the present invention comprising the same structure as described above is explained hereafter.

Figure 7A:
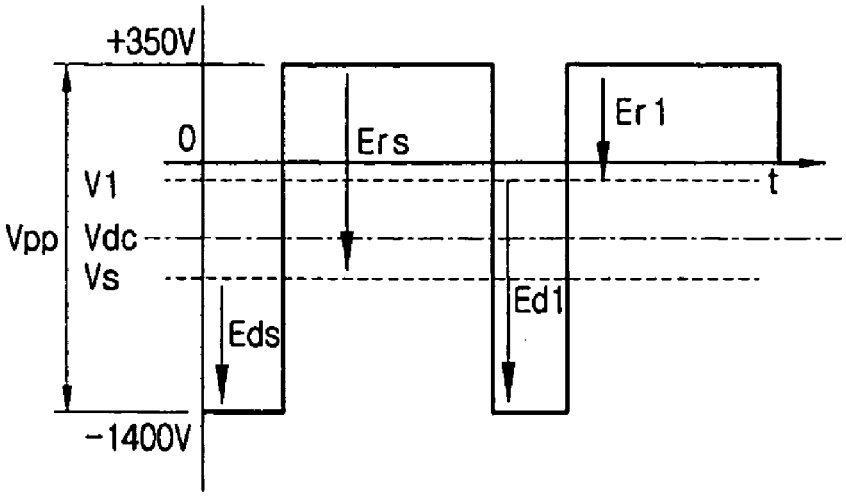
FIG. 7A is a drawing showing voltage applied to the developing part of the electro-photographic image forming apparatus shown in FIG. 5 when printing.

As shown in FIG. 8, when the electro-photographic image forming apparatus receives a signal of print on, the main motor is driven, and the developing roller 40 and the photosensitive medium 1 are driven together. Also, a charging bias that charges the surface of the photosensitive medium 1 is applied so that the surface of the photosensitive medium 1 is charged at a predetermined voltage (for example, Vs=−650V in FIG. 7A). Then the surface of the photosensitive medium 1 is exposed to a laser beam 4 emitted from the laser-scanning unit, and forms an electrostatic latent image (for example, V1=−100V in FIG. 7A) thereon. When the image area of the photosensitive medium 1, where the electrostatic latent image is formed, comes into the developing area, the controller 60 applies the developing bias to the developing roller 40. Here, the developing bias is the alternating current (AC) voltage superposed with the direct current (DC) voltage. As an example, the non-magnetic one-component toner on the surface of the developing roller 40 is regulated in a predetermined thickness and is charged in the minus polarity by abrasion sliding of an abutting portion of the developing roller 40 and the regulating member 7. When the toner with the minus polarity (hereinafter, refer to "minus toner") comes into the developing area, the minus toner reciprocates between the developing roller 40 and the photosensitive medium 1 because the developing bias is the alternating current (AC) voltage. At this time, if the toner is insufficiently charged, the electrical attraction force, which the toner receives from the electric field between the developing roller 40 and the photosensitive medium 1, is weak. Therefore the toner scatters in the direction of the airflow created by the rotation of the photosensitive medium 1 and the developing roller 40. But the scattering preventive member 50, which is disposed at the downstream side of the developing roller 40 adjacent to the photosensitive medium 1, forms the electrical field with the photosensitive medium 1 by applying the same voltage as the developing bias, binds the scattered toner. In other words, the toner that is scattered out of the developing area is attached to either the surface of the photosensitive medium 1 or the scattering preventive member 50 in accordance with the polarity thereof. As shown in FIG. 7A, at a voltage of an image background (Vs=−650V), the minus toner is attached to the scattering preventive member 50 because the size of the recovering electrical field (Ers) is larger than the size of the developing electrical field (Eds). Also, at a voltage of the electrostatic latent image (V1=−100V) the minus toner moves toward the photosensitive medium 1 to develop the electrostatic latent image because the size of the developing electrical field (Eds) is larger than the size of the recovering electrical field (Ers). Because a printing image generally uses image coverage ranging from 5% to 15%, a size of a portion charged at the voltage (Vs) of the image background in the printing area of the photosensitive medium 1 is much larger than a size of a portion charged at the voltage (V1) of the electrostatic latent image. Therefore, most of the minus toner of the scattering toner is stuck to the scattering preventive member 50. Conversely, the plus toner is stuck to the electrostatic latent image portion of the photosensitive medium 1.

After a large number of printing operations, a significant amount of minus toner is stuck to the scattering preventive member 50. Thus, when a large electrostatic latent image such as an all black image is developed, minus toner stuck to the scattering preventive member 50 moves toward the electrostatic latent image portion and scatters onto the electrostatic latent image and the image background. In other words, because contaminating on the image occurs after significant build up of minus toner on the scattering preventive members, an operation cleaning up the minus toner attached to the scattering preventive member 50 needs to be periodically performed.

The controller 60 controls the voltage applied to the scattering preventive member 50, thereby performing the cleaning operation. The controller 60 controls the voltage applied to the scattering preventive member 50 according to a predetermined condition to cause the toner stuck to the scattering preventive member 50 to transport to the non-image area of the photosensitive medium 1.

Figure 7B:
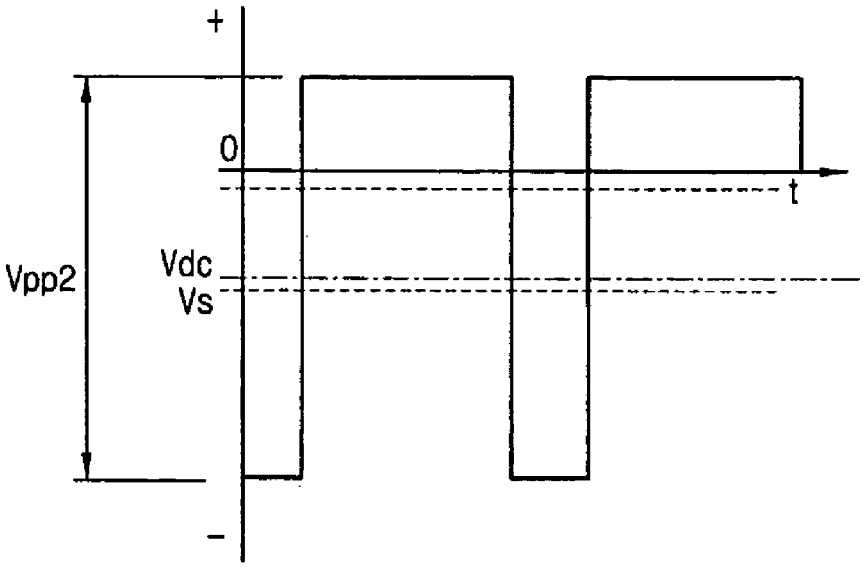
FIG. 7B is a drawing showing voltage applied to the developing part of the electro-photographic image forming apparatus shown in FIG. 5 when the toner attached on the scattering preventive member is cleaned.

One example of the cleaning operation performed by the controller 60 is described referring to a control-timing diagram shown in FIG. 8. After two sheets of paper are printed, the controller 60 forms an all black electrostatic latent image of a predetermined size in the non-image area of the photosensitive medium 1 (see "A" portion of VDO-DATA in FIG. 8). Then, when the all black portion faces the scattering preventive member 50 (see "B" portion of the scattering preventive member in FIG. 8), the controller 60 applies voltage (the cleaning voltage) larger than the voltage applied during a printing operation to the scattering preventive member 50 to cause toner stuck to the scattering preventive member 50 to be transported to the all black portion of the photosensitive medium 1. The size of the cleaning voltage is made larger than the size of the scattering preventive voltage by making Vpp2 larger than Vpp shown in FIG. 7A or to supply an absolute value of Vdc larger than an absolute value of Vdc shown in FIG. 7A as shown in FIG. 7B. At this time, the electrical power source that applies voltage to the developing roller 40 is in an off state. The cleaning operation as described above may be set up to occur just before the main motor will stop at the completion of the printing operation or to occur periodically after a predetermined amount of printing.

Figure 9:
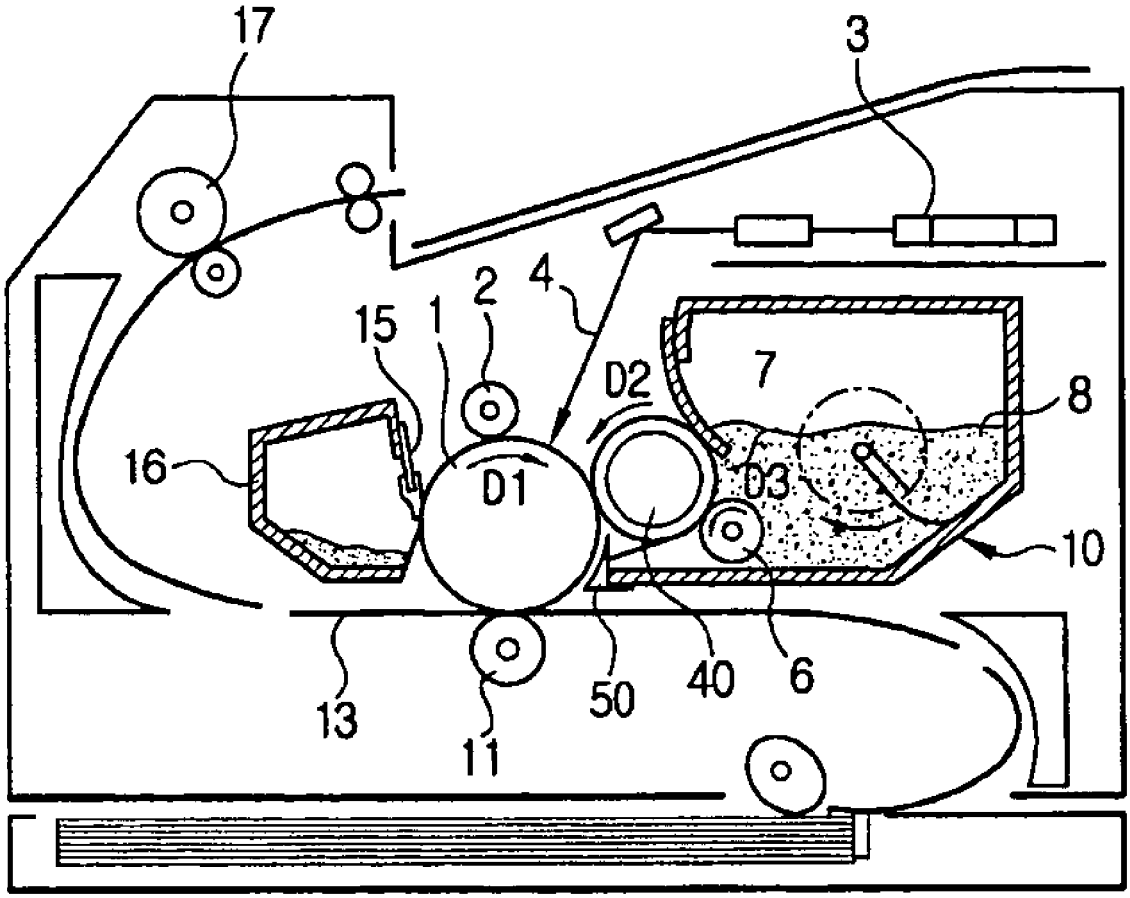
FIG. 9 is a schematic sectional view showing an electro-photographic image forming apparatus preventing toner scattering including the developing part shown in FIG. 5.

The toner, which is transported from the scattering preventive member 50 to the surface of the photosensitive medium 1 during the cleaning operation, is removed from the surface of the photosensitive medium 1 and is collected into the used toner container 16 by a cleaner 15 shown in FIG. 9. The elements with reference numerals in FIG. 9 which are not explained above have the same structure as those of the conventional electro-photographic image forming apparatus, and accordingly, further explanation will be omitted.

Figure 6:
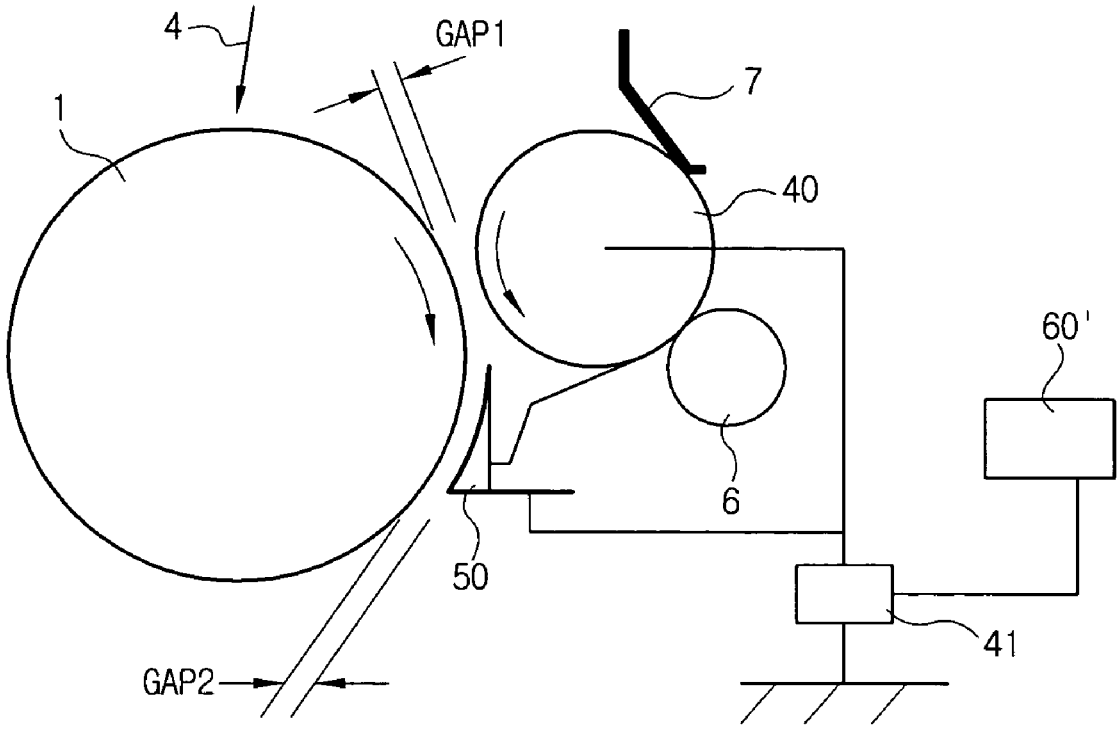
FIG. 6 is a sectional view showing a developing part of the electro-photographic image forming apparatus according to another embodiment of the present invention.

In another embodiment of the present invention, the electrical power source 41 applying the developing bias to the developing roller 40 applies the voltage to the scattering preventive member 50. In other words, as shown in FIG. 6, one electrical power source 41 applies equal voltage to both the scattering preventive member 50 and the developing roller 40. Thus, this embodiment is equal to the embodiment explained above except that the same voltage is applied to the developing roller 40 when the controller 60' applies the voltage to the scattering preventive member 50 for the cleaning operation.

Figure 10:
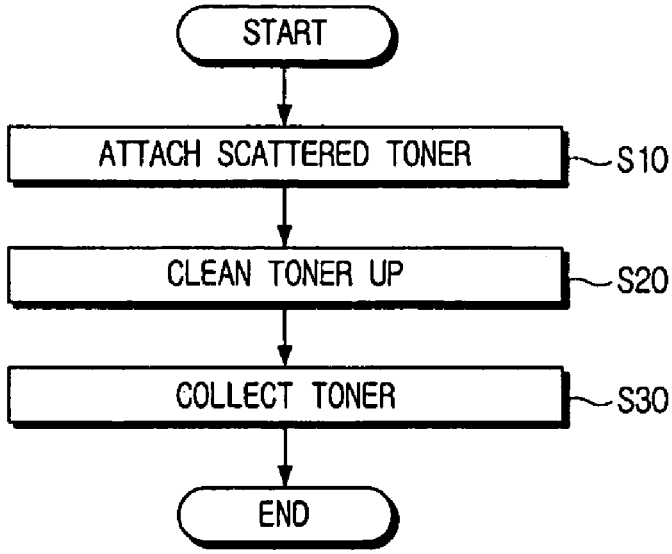
FIG. 10 is a flow chart of the control method of the electro-photographic image forming apparatus according to the present invention.
Figure 11:
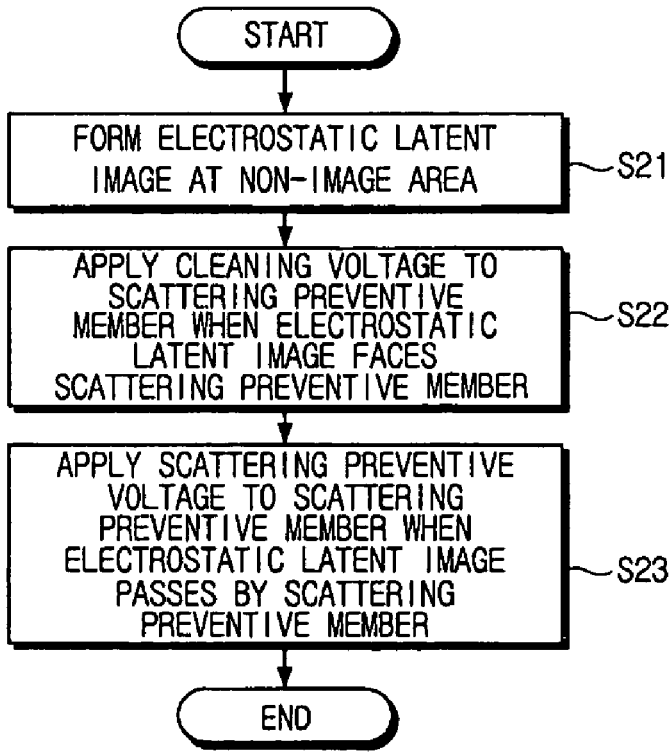
FIG. 11 is a flow chart showing an embodiment of the toner cleaning process shown in FIG. 10.

Hereinafter, as another aspect of the present invention, a control method of the electro-photographic image forming apparatus is described referring to FIGS. 9 to 11.

In a printing operation, the controller 60 applies the same voltage as the developing bias applied to the developing roller 40 to the scattering preventive member 50. The toner scattered out of the developing area while the toner is transported from the developing roller 40 to the photosensitive medium 1 for developing the image area adheres to the scattering preventive member 50 disposed at the downstream side of the developing roller 40 (a scattering toner attaching operation) (S10).

Subsequently, the controller 60 causes the toner stuck to the scattering preventive member 50 to transport to the non-image area of the photosensitive medium 1, thereby cleaning the scattering preventive member 50 (a toner cleaning operation) (S20). At this time, the controller 60 cleans the scattering preventive member 50 according to a predetermined condition for the toner cleaning operation to begin. The predetermined condition that the controller 60 causes the toner cleaning operation to start may be after the electro-photographic image forming apparatus performs a predetermined amount of printing (for example, printing of two sheets of paper) or just before the main motor is stopped with the completion of the printing operation.

As the photosensitive medium 1 rotates, the toner stuck to the non-image area of the photosensitive medium 1 in the toner cleaning operation is removed from the surface of the photosensitive medium 1 and is collected into the used toner container 16 by the cleaner 15 (a toner collecting operation) (S30).

Here, a process that the controller 60 performs the toner cleaning operation (S20) is explained in detail as below. The controller 60 controls the laser-scanning unit, thereby forming an electrostatic latent image in a non-image area of the photosensitive medium 1 (S21). At this time, the controller 60 forms a predetermined size of the electrostatic latent image as an all black image to allow the toner attached to the scattering preventive member 50 to attach as much as possible to the surface of the photosensitive medium 1. Then, the controller 60 applies the cleaning voltage to the scattering preventive member 50 when the electrostatic latent image faces the scattering preventive member 50 as the photosensitive medium 1 rotates (S22). At this time, the controller 60 controls the voltage so that the size of the cleaning voltage applied to the scattering preventive member 50 is larger than the size of the voltage applied to the scattering preventive member 50 during a printing operation, that is, the scattering preventive voltage. When the electrostatic latent image passes by the scattering preventive member 50 as the photosensitive medium 1 rotates, the controller 60 applies the scattering preventive voltage to the scattering preventive member 50 (S23).

Therefore, the electro-photographic image forming apparatus according to the present invention prevents the toner blowing in the developing area during a printing operation from scattering inside thereof because the controller controls the electro-photographic image forming apparatus as described above.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electro-photographic image forming apparatus preventing toner from scattering, which has a photosensitive medium, and a developing roller being opposite to the photosensitive medium and transporting the toner to the photosensitive medium, comprising:

a scattering preventive member being disposed downstream of the developing roller at a predetermined distance from the photosensitive medium, and being applied with a voltage to attach toner to the scattering preventive member; and a controller controlling the voltage that is applied to the scattering preventive member so as to transport the toner attached on the scattering preventive member to the photosensitive medium, wherein a gap between the scattering preventive member and the photosensitive medium is equal to or larger than a gap between the developing roller and the photosensitive medium.

2. The electro-photographic image forming apparatus according to claim 1, further comprising:

an electrical power source, which applies the voltage to the developing roller and the scattering preventive member.

3. The electro-photographic image forming apparatus according to claim 2, wherein the electrical power source is an alternating current (AC) voltage superposed with a direct current (DC) or a direct current (DC) voltage.

4. The electro-photographic image forming apparatus according to claim 1, further comprising:

a first electrical power source which applies the voltage to the scattering preventive member, and a second electrical power source which applies a voltage to the developing roller.

5. An electro-photographic image forming apparatus preventing toner from scattering, which has a photosensitive medium, and a developing roller being opposite to the photosensitive medium and transporting the toner to the photosensitive medium, comprising:

a scattering preventive member being disposed downstream of the developing roller at a predetermined distance from the photosensitive medium, and being applied with a voltage to attach toner to the scattering preventive member; and a controller controlling the voltage that is applied to the scattering preventive member so as to transport the toner attached on the scattering preventive member to the photosensitive medium, wherein the controller controls the voltage applied to the scattering preventive member periodically when a non-image area of the photosensitive medium faces the scattering preventive member so as to transport the toner attached on the scattering preventive member to the photosensitive medium, the controller controls a size of a cleaning voltage, which is applied to the scattering preventive member when the toner attached on the scattering preventive member is transported to the photosensitive medium, such that the size of the cleaning voltage is different from a size of a scattering preventive voltage which is applied to the scattering preventive member when the toner is transported from the developing roller to the photosensitive medium, and the size of the cleaning voltage is larger than the size of the scattering preventive voltage.

6. The electro-photographic image forming apparatus according to claim 5, wherein the controller forms an electrostatic latent image with a predetermined size on the non-image area of the photosensitive medium, and applies the cleaning voltage to the scattering preventive member when the electrostatic latent image faces the scattering preventive member to transport the toner attached on the scattering preventive member to the photosensitive medium.

7. A control method of an electro-photographic image forming apparatus, comprising:

attaching toner, which scatters out of a developing area between a developing roller and a photosensitive medium, to a scattering preventive member disposed downstream of the developing roller;

transporting the attached toner to a non-image area of the photosensitive medium; and collecting the toner transported to the non-image area of the photosensitive medium into a used toner container, wherein the transporting the attached toner comprises:

forming an electrostatic latent image at the non-image area of the photosensitive medium;

applying a cleaning voltage to the scattering preventive member when the electrostatic latent image faces the scattering preventive member; and applying a scattering preventive voltage to the scattering preventive member when the electrostatic latent image passes by the scattering preventive member.

8. The control method of the electro-photographic image forming apparatus according to claim 7, wherein the transporting the attached toner is executed after a predetermined amount of printing, or just before the stopping of a main motor of the electro-photographic image forming apparatus with the completion of a printing operation.

9. An image forming apparatus, comprising:

a photosensitive drum;

a scanning device to form an image on the surface of the photosensitive drum;

a developing device to coat the image formed on the photosensitive drum with toner forming a toner image;

a scattering preventive device to collect the toner which scatters and does not coat the image formed on the photosensitive drum;

a power supply; and a controller that controls voltage applied to the developing device and the scattering preventive device from the power supply, wherein the voltage applied to the developing device causes the toner to coat the image formed on the photosensitive drum and the voltage applied to the scattering preventive device causes the scattered toner to adhere to the scattering preventive device, wherein the controller controls the voltage applied to the scattering preventive device to have a first predetermined voltage level to cause the scattered toner to adhere to the scattering preventive device and a second predetermined voltage level to cause the toner adhered to the scattering preventive device to coat a cleaning image on the photosensitive drum, and an absolute value of the first predetermined voltage is less than an absolute value of the second predetermined voltage.

10. An image forming apparatus, comprising:

a photosensitive drum;

a scanning device to form an image on the surface of the photosensitive drum;

a developing device to coat the image formed on the photosensitive drum with toner forming a toner image;

a scattering preventive device to collect the toner which scatters and does not coat the image formed on the photosensitive drum;

a power supply; and a controller that controls voltage applied to the developing device and the scattering preventive device from the power supply, wherein the voltage applied to the developing device causes the toner to coat the image formed on the photosensitive drum and the voltage applied to the scattering preventive device causes the scattered toner to adhere to the scattering preventive device, wherein the developing device comprises:

a developing roller to coat the image formed on the drum with the toner forming the toner image, and a toner supply to supply the toner to the developing roller, the power supply comprises:

a first power supply to supply a first voltage to the developing roller, and a second power supply to supply a second voltage to the scattering preventive device, wherein the controller controls the first power supply and the second power supply to cause the toner from the developing roller to coat the image formed on the photosensitive drum and the voltage applied to the scattering preventive device causes the scattered toner to adhere to the scattering preventive device, respectively, and the first voltage is equal to the second voltage.

11. An image forming apparatus, comprising:

a photosensitive drum;

a scanning device to form an image on the surface of the photosensitive drum;

a developing device to coat the image formed on the photosensitive drum with toner forming a toner image;

a scattering preventive device to collect the toner which scatters and does not coat the image formed on the photosensitive drum;

a power supply; and a controller that controls voltage applied to the developing device and the scattering preventive device from the power supply, wherein the voltage applied to the developing device causes the toner to coat the image formed on the photosensitive drum and the voltage applied to the scattering preventive device causes the scattered toner to adhere to the scattering preventive device, wherein the developing device comprises:

a developing roller to coat the image formed on the drum with the toner forming the toner image, and a toner supply to supply the toner to the developing roller, the scattering preventive device comprises a conductive curved surface separated from the photosensitive drum by a first predetermined gap, and the first predetermined gap between the scattering preventive device and the photosensitive drum is larger than a second predetermined gap between the developing roller and the photosensitive drum.

12. An image forming apparatus, comprising:

a photosensitive drum;

a scanning device to form an image on the surface of the photosensitive drum;

a developing device to coat the image formed on the photosensitive drum with toner forming a toner image;

a scattering preventive device to collect the toner which scatters and does not coat the image formed on the photosensitive drum;

a power supply; and a controller that controls voltage applied to the developing device and the scattering preventive device from the power supply, wherein the voltage applied to the developing device causes the toner to coat the image formed on the photosensitive drum and the voltage applied to the scattering preventive device causes the scattered toner to adhere to the scattering preventive device, wherein the controller controls the voltage applied to the scattering preventive device to have a first predetermined voltage level to cause the scattered toner to adhere to the scattering preventive device and a second predetermined voltage level to cause the toner adhered to the scattering preventive device to coat a cleaning image on the photosensitive drum, and the cleaning image is formed on a predetermined surface of the photosensitive drum, which is different from the surface of the photosensitive drum forming the toner image.

13. The image forming apparatus of claim 12, wherein the controller causes the second predetermined voltage level to be applied to the scattering preventive device when a predetermined number of toner images have been formed.

14. A method of preventing scattered toner in an image forming apparatus, including a photosensitive drum to form electrostatic images, from deteriorating a toner image, comprising:

collecting toner blowing in a developing area during a printing operation of the image forming apparatus; and disposing of the collected toner after a predetermined number of printing operations, wherein the collecting toner comprises applying a predetermined voltage to a conductive collector to attract the toner blowing in the developing area, the disposing of the collected toner comprises applying a cleaning voltage to the conductive collector to cause the collected toner to adhere to the photosensitive drum, wherein the collected toner is cleaned off of the conductive collector, and the applying the cleaning voltage to the conductive collector occurs just prior to a main drive motor stopping.

15. The method of claim 14, wherein the applying the cleaning voltage to the conductive collector occurs after a predetermined number of printing operations.

* * * * *